United States Patent [19]

Woloski et al.

[11] 4,424,554

[45] Jan. 3, 1984

[54] CEILING FIXTURE WITH IMPROVED MOUNTING MEANS

[75] Inventors: Leonard E. Woloski, Jersey City; Walter E. Wyles, Somerset, both of N.J.

[73] Assignee: Lightolier Incorporated, Jersey City, N.J.

[21] Appl. No.: 426,173

[22] Filed: Sep. 28, 1982

[51] Int. Cl.[3] ..... F21S 1/06

[52] U.S. Cl. ..... 362/365; 362/150; 362/217; 362/404; 362/430

[58] Field of Search ..... 362/365, 150, 217, 404, 362/430

[56] References Cited

U.S. PATENT DOCUMENTS

| | | | |
|---|---|---|---|
| 3,943,355 | 3/1976 | Lundy | 362/374 |
| 4,332,005 | 5/1982 | McCall | 362/374 |

*Primary Examiner*—Stephen J. Lechert, Jr.

*Attorney, Agent, or Firm*—Arthur B. Colvin

[57] ABSTRACT

A recessed ceiling mounted lighting fixture is disclosed, characterized in the incorporation of improved mounting means for effecting connection thereof to a ceiling tile support grid. The mounting means includes spring projected latches which may be readily released to a grid engaging position by the installer and which automatically hold the fixture in a predetermined heightwise relation to the ceiling.

5 Claims, 5 Drawing Figures

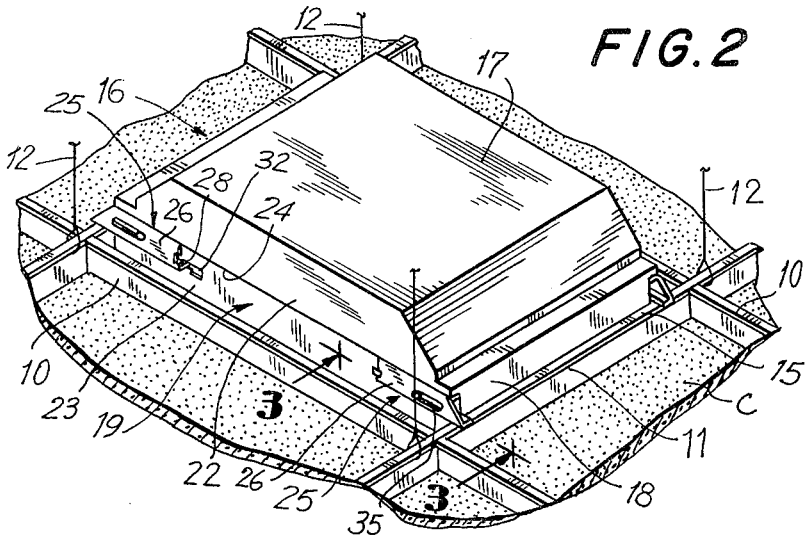
FIG. 2
FIG. 4
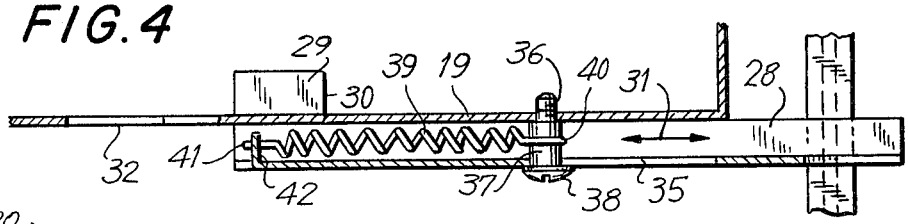
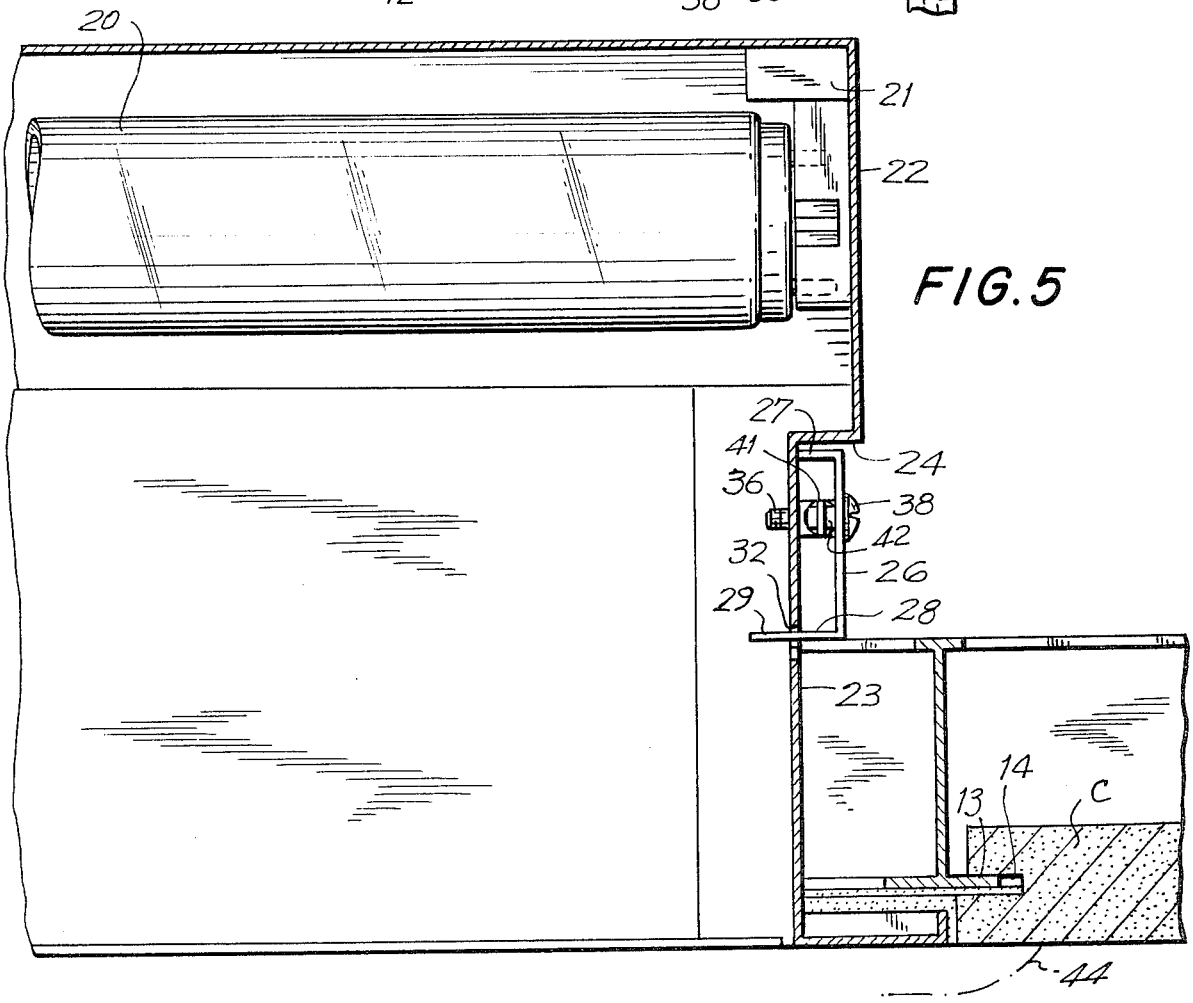
FIG. 5

CEILING FIXTURE WITH IMPROVED MOUNTING MEANS

BACKGROUND OF THE INVENTION

This invention relates to a ceiling mounted fixture and more particularly to a recessed lighting fixture adapted to be mounted to the gridwork which supports a tile ceiling or the like.

THE PRIOR ART

It is known to provide a lighting fixture such as a rectangular fluorescent lighting fixture having means or mechanism to support the fixture to the gridwork, which carries the ceiling tiles. In the typical fixture of the type described, connection between the housing or reflector of the fixture and the gridwork supporting the ceiling is provided by laterally extending mounting lugs fixed to each corner of the reflector. The mounting lugs project laterally from the sides of the fixture and must be individually adjusted to overlie the ceiling support members. The lateral projection of the conventional lug structures, precluded the possibility of utilizing space to either side of the fixture, such as might be needed for air boots and/or wiring devices.

Conventional lug supports for lighting fixtures have the additional disadvantage that each of the lugs is supported by one or more screws which must be individually adjusted to achieve a desired heightwise alignment of the corners of the fixture. It is thus necessary with conventional fixtures of the type described, either to utilize two operators for effecting an installation, one to support an end of the fixture while the other adjusts the mounting mechanisms, or if one operator is to effect the installation, for an initial adjustment of the mounting lugs at one end of the fixture to be made, a subsequent implacement of the other end of the fixture, adjustment of the lugs at the other end, and finally a return to the first end to finalize the heightwise orientation.

As will be evident from the preceeding description the mounting of conventional lighting fixtures is time consuming and wasteful of space.

SUMMARY OF THE INVENTION

The present invention may be summarized as directed to a lighting fixture for installation in recessed condition in a tiled ceiling construction and having a novel mounting means which greatly facilitate installation thereof, and which, in addition, provides the mounting means in a disposition in which the space adjacent the fixture can be used for ancillary equipment such as air boots, wiring devices or the like.

More particularly, the lighting device of the present invention is characterized in the provision at the corners thereof, of spring projected latch members which are disposed in retracted position prior to installation of the fixture. When it is desired to mount the fixture it is merely necessary to dispose the same at a desired position above the gridwork of a ceiling structure and trip the latch members whereupon they are projected outwardly into overlying relation to the skeletal structure supporting the ceiling tiles. In the retracted position the latch members are completely contained within the configuration of the fixture. In the projected or fixture supporting configuration the latch members project beyond the ends of the fixture a distance sufficient to engage over the T-bars or like supporting structure for the ceiling tile members, but not laterally beyond the confines of the fixture, whereby a minimum of space is wasted.

It is accordingly an object of the present invention to provide a lighting fixture having improved mounting means. A further object of the invention is the provision of a ceiling mounted fixture characterized in that the same includes spring projected mounting latches at the corners thereof, whereby proper mounting of the fixture may be effected by merely adjusting the fixture to its desired position and tripping the latches at the corners of the fixture whereupon the fixture becomes self-supported. Still further objects will appear herein or be hereinafter pointed out in connection with the description of the drawings wherein;

FIG. 2 is a view similar to FIG. 1 showing the position of the parts in the mounted condition of the fixture.

FIG. 4 is a discontinuous horizontal section taken on the line 4—4 of FIG. 3.

FIG. 5 is a discontinuous vertical section taken on the line 5—5 of FIG. 3.

Figure 1:
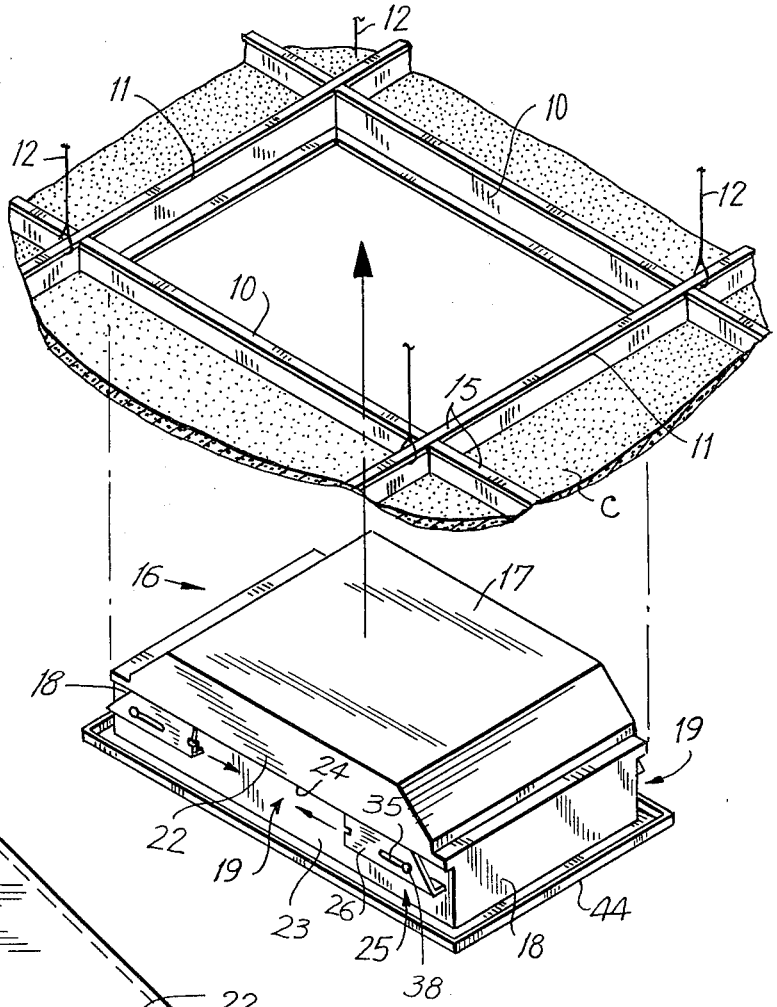
FIG. 1 is a perspective view taken in a downward direction of a portion of a ceiling assembly showing a fixture in accordance with the invention at its pre-mounted position.

Turning now to the drawings there is shown in FIG. 1 and 2 a ceiling structure which includes a multiplicity of longitudinally extending T-bars 10, which are joined to a multiplicity of laterally extending T-bars 11, the bars 11 being hung from the building super structure by depending support wires 12. The gridwork construction utilized for holding the ceiling tiles C is known per se and need not be described in further detail. It is sufficient to note that the skeleton structure which is comprised of the members 10 and 11 includes horizontally disposed lower leg portions 13, which enter into support slots 14 of the ceiling tiles C in order to hold the tiles in the ceiling defining position thereof. It should further be noted that the uppermost ends of the bars 10, 11 are defined by horizontally extending short support shoulders 15, it being these shoulders which are utilized as the supporting surfaces for the fixture in a manner to be hereinafter described.

The fixture 16, which is generally rectangular in plan, includes a top wall portion 17, end wall 18, 18 and side walls 19, 19. A lighting element 20 illustratively a fluorescent bulb or bulbs is mounted within terminal fixtures 21 in a manner known per se.

As is apparent from FIGS. 1, 2 and 5 the sidewalls 19 include an upper outwardly extending portion 22 and a lower recessed portion 23, a horizontal ledge member 24 being defined at the interface between the portions 22 and 23.

At each of the corners of the fixture there is mounted a movable latch assembly 25, the latch assembly being shiftable in a direction parallel to sidewalls 19. Since each of the latch assemblies 25 functions in an identical manner a description of one will suffice.

The latch members 25 comprise elongate metallic members which are generally U-shaped in transverse section including a vertically directed central branch 26 an upper horizontal leg 27 and a lower horizontal leg 28. For purposes which will appear hereinafter the lower horizontal leg 28 includes a laterally extending latch bar 29 having an outwardly directed latching face 30.

Figure 3:
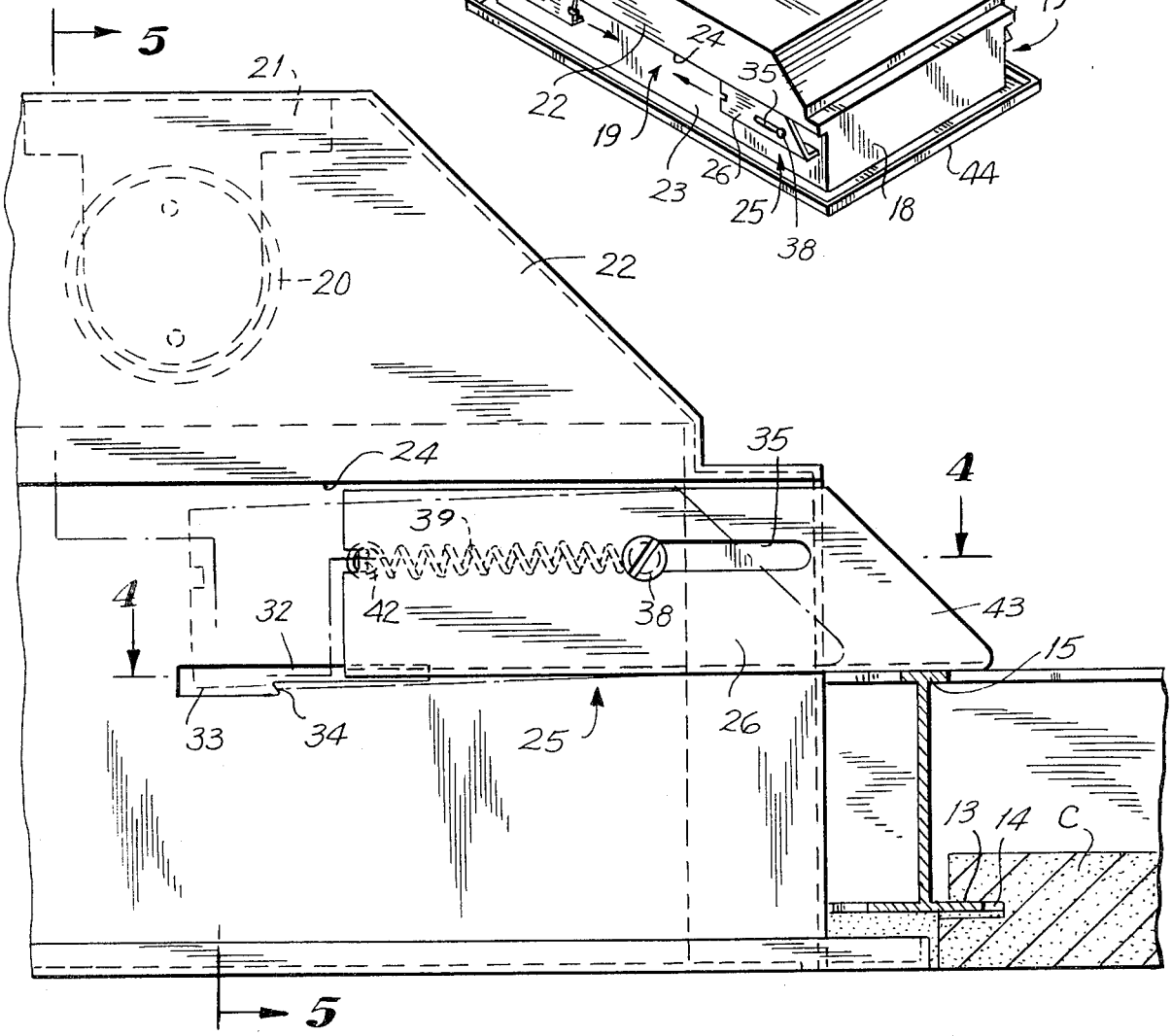
FIG. 3 is a magnified fragmentary vertical section taken on the line 3—3 of FIG. 2.

The latch members 25 are mounted for sliding movement parallel to the sidewalls 19 in the direction of the arrow 31 (FIG. 4). To this end a horizontally directed slot 32 is formed in the sidewalls 19, the latch fingers 29 extending inwardly into the interior of the reflector assembly through the said slots 32. As best seen in FIG. 3 the slot 32 adjacent its inner end 33 is enlarged to define a clearance area terminating in a retainer or detent shoulder 34.

The latch members 25 in the vertically directed branch wall 26 thereof are formed with longitudinally extending slots 35. A machine screw 36 is threaded into the wall 19 and extends through the slot 35. A spacer sleeve 37 is clamped against the wall 19 between the head 38 of the screw 36 and the said wall. The diameter of the head 38 of the screw is larger than the transverse dimension of slot 35 from which it will be perceived that the latch member 25 is guided for sliding movement parallel to the wall 19 by the slotted arrangement described.

The latch members 25 are spring biased to a normal outward or projected orientation as depicted in FIG. 4 by a coil spring member 39 one end 40 of which is looped about the body of the spacer 37 and the other end 41 of which is anchored to a retainer tab 42 integral with the wall 26 of the latch member 25.

Referring now, more particularly, to FIG. 3 the latch member 25 is shown in such figure in its two operative positions, namely in a retracted position (dot and dash lines) and a projected position (solid lines). As clearly disclosed in FIG. 3 the latch member 25 may be retained in its retracted position by the engagement of stop surface 30 of detent finger 29 against detent shoulder 34.

The operation of the device will be evident from the preceeding description. The device as supplied is shipped preferably with the latch members 25 in the retracted or dot and dash position of FIG. 3. After the wiring connections (not shown) are effected between the lighting fixture 16 and the power mains, the fixture is merely lifted upwardly from the position shown in FIG. 1 to that of FIG. 2.

With the fixture at a level above the support bar 15 of the grid structure, the latch members 25 are caused to extend or project by merely tilting the nose 43 of the latch members downwardly or lifting the members 29 to clear the detent 29 from the stop shoulder 34. The latch members 25 will thus spring outwardly to the projected position shown in solid lines, FIG. 3, whereat they overlie the support surfaces 15.

The fixture may now be released and will be supported at a correct heightwise disposition within the ceiling gridwork. Optionally, but preferably, in the projected position of the latches, the upper surface 27 of the latch may graze or engage against the ledge member 24 on the outer wall of the fixture under the weight of the fixture. This arrangement assures a somewhat more secure rigid interconnection between the parts than would be the case if the weight of the assembly were supported by interaction of the slots 35 and the spacers 37.

As will be apparent from the preceeding description there is shown in accordance with the invention a lighting fixture especially adapted to be mounted to the gridwork of a ceiling tile support structure, characterized in that the fixture may be readily mounted by tripping spring projected latch members which in turn rest on portions of the grid to establish a predetermined heightwise orientation of the fixture to the grid. It will be understood that the reflector carries a removable or openable lens assembly 44, which after mounting of the reflector is swung or shifted upwardly so as to underlie and hide the interface between ceiling structure and reflector assembly.

It will be evident to skilled workers in the art familiarized with the instant disclosure that numerous variations in details of construction from those illustrated in the described embodiment may be made without departing from the spirit of the invention.

Accordingly, the invention is to be broadly construed within the scope of the appended claims.

Having thus described the invention and illustrated its use, what is claimed as new and is desired to be secured by Letters Patent is:

1. A recessed lighting fixture adapted to be mounted to a ceiling tile support grid or the like comprising a generally rectangular downwardly open light housing having parallel side and end walls and a top wall, each of the said side walls having movably mounted thereon a support latch assembly shiftable in a path parallel to said sidewalls from a retracted position whereat said latch members are disposed inwardly of said end walls to an extended position whereat portions of said latch members project beyond said end walls, horizontal ledge portions extending laterally from said side walls and overlying said latch members, said latch members each including spring means biased between same and said housing and yieldingly urging the same outwardly toward said projected position, and detent means interposed between said latch members and said housing releasably retaining said latch members in said retracted position against the force of said spring means, said latch members further including a horizontal top wall portion underlying said ledge portions, said latch members being mounted for limited pivotal movement relative to said housing, whereby said top wall portions of said latch members are biased into abutting relation to said ledge portions by the weight of said fixture in said projected position of said latch members.

2. A fixture in accordance with claim 1 wherein said latch members each include a clearance slot extending parallel to said ledge members, and a guide pin member extending from said housing into each said slot to thus support said latch member for said generally parallel movement.

3. A fixture in accordance with claim 1 wherein said detent means comprises a guide slot formed in said sidewalls of said housing adjacent each said latch member, a retainer ledge portion on said slots, a tail piece formed on said latch members and projecting through said guide slots to the interior of said housing, said latch members being retained in said retracted position by the engagement of said tail pieces and said retainer ledge portions.

4. A fixture in accordance with claim 3 wherein the clearance between said guide pin and clearance slot on the one hand and said tail piece and guide slot on the other hand permit limited tilting movement of said latch members relative to said housing whereby said tail pieces may be selectively engaged with or disengaged from said retainer ledge portions to shift said latch between said retracted and projecting positions respectively.

5. A fixture in accordance with claim 4 wherein the lateral extent of said ledge members exceeds the thickness of said latch members whereby said latch members do not project laterally outwardly beyond a downward projection of said housing.

* * * * *